US009650197B1

(12) United States Patent
Efstathiou et al.

(10) Patent No.: US 9,650,197 B1
(45) Date of Patent: May 16, 2017

(54) COLLAPSIBLE PORTABLE CONTAINER AND METHOD FOR MIXING TWO SUBSTANCES

(71) Applicants: Marios Efstathiou, Delray Beach, FL (US); Tamara Denise Riley, Delray Beach, FL (US)

(72) Inventors: Marios Efstathiou, Delray Beach, FL (US); Tamara Denise Riley, Delray Beach, FL (US)

( * ) Notice: Subject to any disclaimer, the term of this patent is extended or adjusted under 35 U.S.C. 154(b) by 0 days.

(21) Appl. No.: 14/955,594

(22) Filed: Dec. 1, 2015

(51) Int. Cl.

| | |
|---|---|
| ***B65D 25/08*** | (2006.01) |
| ***B65D 81/32*** | (2006.01) |
| ***B65D 35/10*** | (2006.01) |
| ***B65D 35/22*** | (2006.01) |
| ***B65D 35/56*** | (2006.01) |
| ***B65D 35/24*** | (2006.01) |

(52) U.S. Cl.
CPC ..... *B65D 81/3266* (2013.01); *B65D 35/10* (2013.01); *B65D 35/22* (2013.01); *B65D 35/242* (2013.01); *B65D 35/56* (2013.01)

(58) Field of Classification Search
CPC B65D 81/3266; B65D 81/3261; B65D 35/10; B65D 35/22; B65D 35/242; B65D 35/56
USPC ..... 206/219, 222
See application file for complete search history.

(56) References Cited

U.S. PATENT DOCUMENTS 5,170,888 A * 12/1992 Goncalves ..... B65D 81/3211 206/222
5,417,991 A * 5/1995 Green ..... B65D 1/0223 219/734
5,676,244 A 10/1997 Green et al.
6,042,858 A 3/2000 Kairys
6,840,373 B2 1/2005 Gibler et al.
6,913,405 B2 * 7/2005 Fischer ..... A45D 34/04 220/669
8,172,078 B1 5/2012 Vogel
8,622,209 B2 1/2014 Isaac et al.
8,863,948 B2 * 10/2014 Ogawa ..... A61J 1/2093 206/222
8,871,285 B2 10/2014 Markoulis et al.
2006/0191805 A1 8/2006 Vogel et al.
2010/0084021 A1 4/2010 Karabinis
2010/0163439 A1 7/2010 Gutierrez Avendano
2011/0272379 A1 11/2011 Eghbaly
(Continued)

FOREIGN PATENT DOCUMENTS

WO WO2014173933 A1 10/2014

*Primary Examiner* — Steven A. Reynolds
*Assistant Examiner* — Javier A Pagan
(74) *Attorney, Agent, or Firm* — Mark C. Johnson; The IP Law Firm, PLLC

(57) ABSTRACT

A collapsible portable container for mixing two substances comprising a first segment defining a first enclosed volume for housing a first substance, a second segment having side walls operably configured to collapse and defining a second enclosed volume for housing a second substance, a puncturing member disposed within the second enclosed volume, and a partition disposed in an interposing relationship between the first segment of the container and the second segment of the container, wherein the side walls of the second segment is operably configured to compress, thereby translating the puncturing member so as to pierce the partition and fluidly couple the first enclosed volume and the second enclosed volume.

20 Claims, 8 Drawing Sheets

(56) References Cited

U.S. PATENT DOCUMENTS

| | | | | |
|---|---|---|---|---|
| 2013/0068653 | A1* | 3/2013 | Lipinski | B65D 75/02<br>206/524.1 |
| 2014/0246343 | A1 | 9/2014 | Sebille et al. | |

* cited by examiner

100

COLLAPSIBLE PORTABLE CONTAINER AND METHOD FOR MIXING TWO SUBSTANCES

FIELD OF THE INVENTION

The present invention relates generally to a portable container for mixing two substances and, more particularly, relates to a collapsible portable container for mixing two substances.

BACKGROUND OF THE INVENTION

Using containers to hold and transport substances, such as fluids, are well known. Some of these portable containers include water bottles, beer bottles or jugs, energy drink cans, among many more types of containers. Many users desire these containers to hold a constituent formulated or composed of two substances for mixing or otherwise combining in the future. In many instances, the two substances making up the constituent in the container are not able, are impracticable, or are not desired to be combined before they are ultimately consumed by the end user. One example includes a baby bottle having formula composed of a liquid base such as water, or "solvent," and a vitamin-based powder, or "solute," that is intended to be combined with the liquid base.

Some known devices and methods of providing users the ability to mix substances held or placed within the container include a bottle having a partition disposed within the container, wherein the partition separates the two substances so that they cannot be mixed before intended. These devices are designed for the user to remove the partition, either by having the user pull the partition or puncture the partition, so that the two substances may mix. These devices and methods are problematic for many users because the partition often gets jammed or lodged by the container itself when removing. Additionally, many users, such as children or the elderly, are unable or find it difficult to remove the partition because it is adhered to the container with a strong binding adhesive or other fastener, or the partition does not have any portion for the user to grasp.

Another known device and method enabling users to mix fluids or other substances in a portable container includes that which is disclosed in U.S. Patent Application Publication Number 2014/0246343, Sebille et al. ("Sebille"). This device, however, has many disadvantages not desired by users. Specifically, in order to puncture the partition separating the two substances the user is required to manually employ a force on the striker in order translate the striker. This disadvantageously requires the user to use two hands and the amount of force required to translate the striker is often difficult or impossible for individuals such as children and the elderly.

Moreover, the striker in Sebille is specifically designed to be molded as one piece with the base, wherein the striker is able to be mobile via a pliable wall attached to an inner surface of the base. Sebille describes that chemical adhesive is preferred to be used with attaching the pliable wall with the inside surface of base as it is "vital" that there is a perfect seal. As such, manufacturing and/or production costs associated with the device in order to comply with the vital requirement of a perfect seal are increased.

Therefore, a need exists to overcome the problems with the prior art as discussed above.

SUMMARY OF THE INVENTION

The invention provides a collapsible portable container for mixing two substances that overcomes the hereinaforementioned disadvantages of the heretofore-known devices and methods of this general type and that is operably configured to have a portion translate with a puncturing member to pierce a partition, thereby enabling two substances housed in the container to mix.

With the foregoing and other objects in view, there is provided, in accordance with the invention, a collapsible portable container for mixing two substances that includes a portable container body with a first segment defining a first enclosed volume for housing a first substance, wherein the first segment has a spout defining an upper terminal edge and a second segment with side walls operably configured to collapse and defining a second enclosed volume for housing a second substance, wherein the second segment with a lower terminal edge opposite the upper terminal edge. The container also includes a puncturing member disposed within the second enclosed volume and spanning in a longitudinal direction of the container body and a partition disposed in an interposing relationship between the first segment and the second segment, wherein the partition operably configured to fluidically seal the first enclosed volume from the second enclosed volume. The side walls of the second segment and the puncturing member are beneficially configured to have a first position along a second segment translation path with the puncturing member disposed in a non-piercing configuration with respect to the partition and a second position along the second segment translation path with the side walls in a compressed state and with the puncturing member disposed in a piercing configuration with respect to the partition, fluidly coupling the first enclosed volume and the second enclosed volume.

In accordance with a further feature of the present invention, the side walls are of a pleated configuration when in the first and second positions along the second segment translation path. In other embodiments, the side walls are of a flexible polymeric material.

In accordance with another feature, an embodiment of the present invention includes a removable jacket coupled to the second segment and at least partially surrounding an outer surface of the side walls of the second segment, the removable jacket restricting movement of the side walls of the second segment and the puncturing member along the second segment translation path.

In accordance with yet another feature, an embodiment of the present invention includes the jacket further having a plurality of perforations spanning the jacket in a longitudinal direction of the container body to permit easy and efficient removal. The jacket may also have an upper end and a lower end opposing the upper end of the jacket, wherein the upper end and lower end of the jacket are respectively flanked by an upper shelf defined by the first segment and a lower shelf defined by the second segment when in the first position along the second segment translation path.

In accordance with an additional feature, an embodiment of the present invention includes the container having a container length defined by the upper terminal edge and the lower terminal edge, wherein the container length in the first position along the second segment translation path is greater than the container length when in the second position along the second segment translation path.

In accordance with a further feature of the present invention, the puncturing member of a conical shape and the first and second segments are of a cylindrical shape. Additionally, the first segment may be of a cylindrical shape and include a concave outer surface spanning in a longitudinal direction of the container body.

In accordance with an additional feature, an embodiment of the present invention includes the first segment having a plurality of notches disposed on an outer surface of the first segment and separated by the concave outer surface of the first segment defining a hand placement zone.

In accordance with a further feature of the present invention, the second segment translation path is linear and in a longitudinal direction of the container body.

In accordance with the present invention, a collapsible portable container for mixing two substances is also disclosed that includes a portable container body having a first segment defining a first enclosed volume and an upper aperture fluidly coupled to the first enclosed volume and a second segment having side walls of a pleated configuration operably configured to collapse and defining a second enclosed volume, a puncturing member disposed within the second enclosed volume, and a partition disposed in an interposing relationship between the first segment and the second segment, the partition operably configured to fluidically seal the first enclosed volume from the second enclosed volume. The container also includes the pleated side walls of the second segment and the puncturing member having a first position along a second segment translation path with the puncturing member disposed in a non-piercing configuration with respect to the partition and a second position along the second segment translation path with the pleated side walls in a compressed state and with the puncturing member disposed in a piercing configuration with respect to the partition, fluidly coupling the first enclosed volume and the second enclosed volume.

In accordance with a further feature of the present invention, the pleated side walls are of a flexible polymeric material.

In accordance with the present invention, a method of mixing two substances in a collapsible container is also disclosed that includes providing a portable container body having a first segment defining a first enclosed volume and an upper aperture fluidly coupled to the first enclosed volume, a second segment having side walls operably configured to collapse and defining a second enclosed volume, a puncturing member disposed within the second enclosed volume, and a partition disposed in an interposing relationship between the first segment and the second segment, the second segment including a lower terminal edge surrounding a bottom surface of the container body. The method also includes applying a force to the lower terminal edge of the second segment surrounding the bottom surface of the container body to (1) compress the side walls in a longitudinal direction of the container body, (2) translate the puncturing member in the longitudinal direction of the container body, and (3) pierce the partition with the puncturing member, thereby fluidly coupling the first and second enclosed volumes.

In accordance with an additional feature, an embodiment of the present invention includes applying a force to the lower terminal edge of the second segment surrounding the bottom surface of the container to compress the side walls a second segment and reduce an entire length of the second segment, the entire length of the second segment defined by the lower terminal edge of the second segment and an upper end of the second segment opposing the lower terminal edge of the second segment.

Although the invention is illustrated and described herein as embodied in a collapsible portable container for mixing two substances, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the container spanning from a lower terminal edge of the container to an upper edge of the container where the spout or aperture is located.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
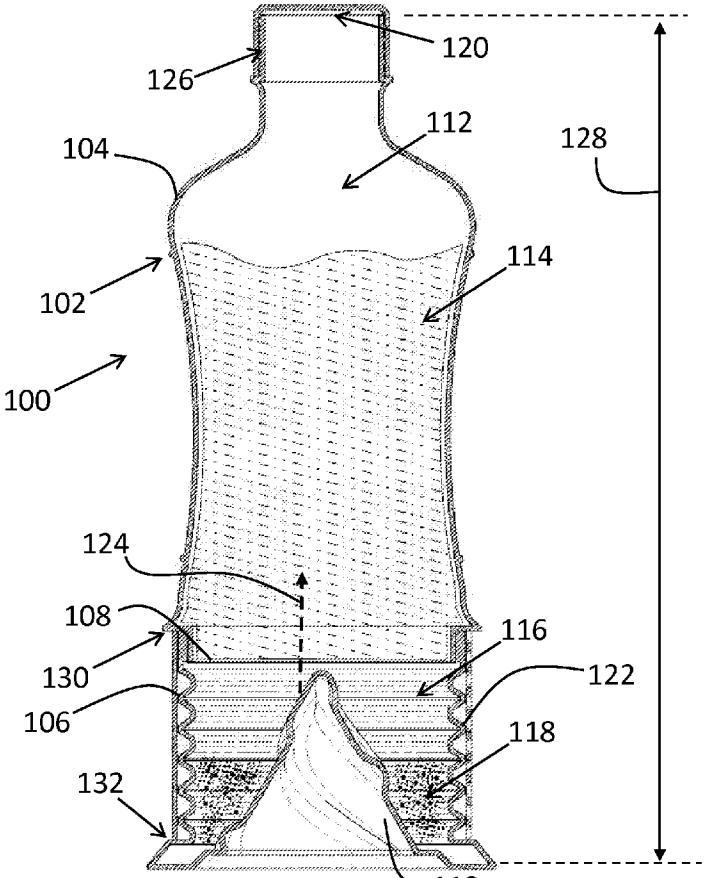
FIG. 1 is a cross-sectional view of a collapsible portable container in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient device and method for mixing multiple substances together. Referring now to FIG. 1, one embodiment of the present invention is shown in a cross-sectional view about a longitudinal axis of the container 100. FIG. 1 shows several advantageous features of the present invention, but, as will be described below, the invention can be provided in several shapes, sizes, combinations of features and components, and varying numbers and functions of the components. The first example of a collapsible container 100 for mixing two more substances, as shown in FIG. 1, includes a portable container body 102 having a first segment 104 and a second segment 106. The present invention also includes a partition 108 and a protruding member 110 operably configured to pierce or otherwise open the partition so that a first substance housed in the first segment 104 can mix with a second substance housed in the second segment 106. The container 100 is portable in that it is capable of being carried and transported solely by the user's hands.

The first segment 104 can be seen defining a first enclosed volume 112 for housing a first substance 114, e.g., water, and the second segment 106 can be seen having defining a second enclosed volume 116 for housing a second substance 118, e.g., protein powder. While the substances 114, 118 are preferably composed of different constituents, such as a liquid solvent and a powder solute, the present invention is not so limited. There may be more than two substances, the substances may be of the same constituent, and they may be of varying consistencies and/or materials. The present invention is particularly beneficial, however, for users desirous of taking powder-based supplements with a liquid vehicle.

To enable a fluid or other substance, whether combined with another substance or not, from exiting the container 100, the first segment 104 includes a spout 126 or aperture 120 and an upper terminal edge 200. The container 100 also includes a lower terminal edge 202 opposing the upper terminal edge 200, which can be better seen in the exploded view of the container 100 shown in FIG. 2. Still referring to FIG. 1, the second segment 106 has side walls 122 that define the enclosed volume 116 and is operably configured to collapse or compress so as to translate the puncturing member 110 disposed therein. In one embodiment, the puncturing member 110 and the side walls 122 are integrally formed as one piece of material, via, e.g., injection molding. In other embodiments, the puncturing member 110 and the side walls 122 are formed of various components and coupled together so they may translate simultaneously upon being subjected to a force at the lower terminal end 202 or other point of contact of the second segment 106. As opposed to those known devices, the side walls 122 are operable to compress by applying a force to the lower terminal edge 202 through, for example, a user's hand, a standing structure (e.g., wall), or a ground surface. The side walls 122 may be one continuous wall or may be a plurality of walls that enclose, or surround on all sides, the substance(s) housed therein. Contrary to those known devices, the container 100 of the present invention is operable to fluidly couple the first and second volumes 112, 116 with a user holding the container 100 in one hand and in one motion or impetus by the user.

The puncturing member 110 can be seen spanning in a longitudinal direction of the body 102 and, in one embodiment, is of a conical shape to provide effective and efficient puncturing of the partition 108. The puncturing member 110 may also have fins or other protrusions that may be of a spiral or helical configuration to effectuate fluid coupling the first and second enclosed volumes 112, 116. The partition 108 can be seen disposed in an interposing relationship between the first segment 104 and the second segment 106. In one embodiment, the partition 108 is of a metallic foil material. In other embodiments, the partition is a polymeric membrane material or other material operably configured to fluidically seal the first enclosed volume 112 from the second enclosed volume 116 until it is penetrated by the puncturing member 110.

Figure 3:
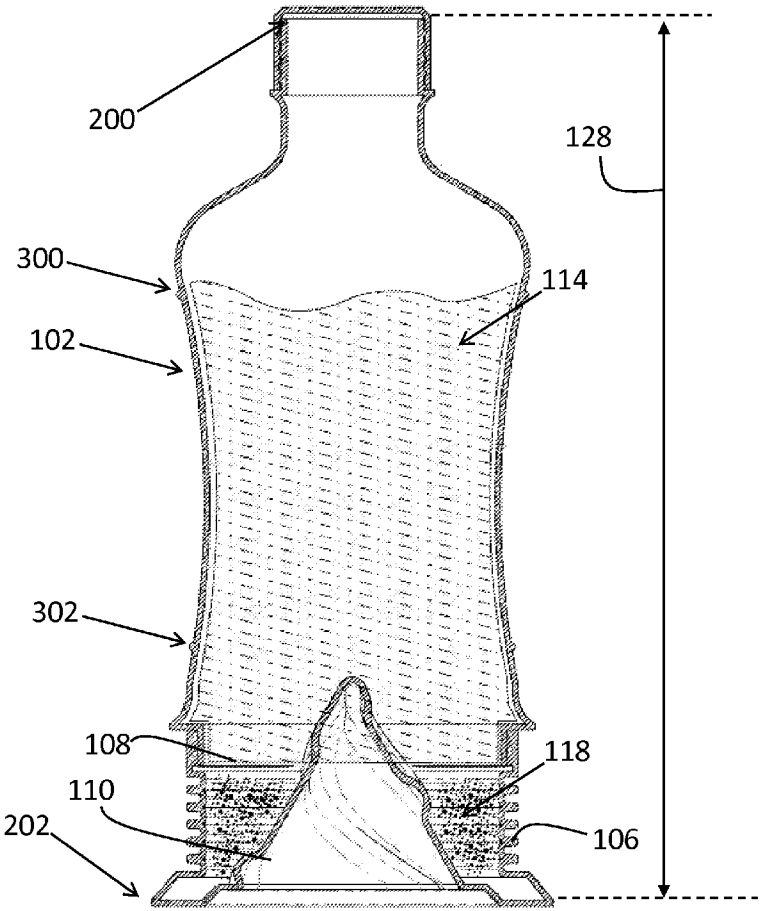
FIG. 3 is a cross-sectional view of the container of FIG. 1 with the puncturing member in a piercing configuration with a partition in accordance with one embodiment of the present invention.
Figure 4:
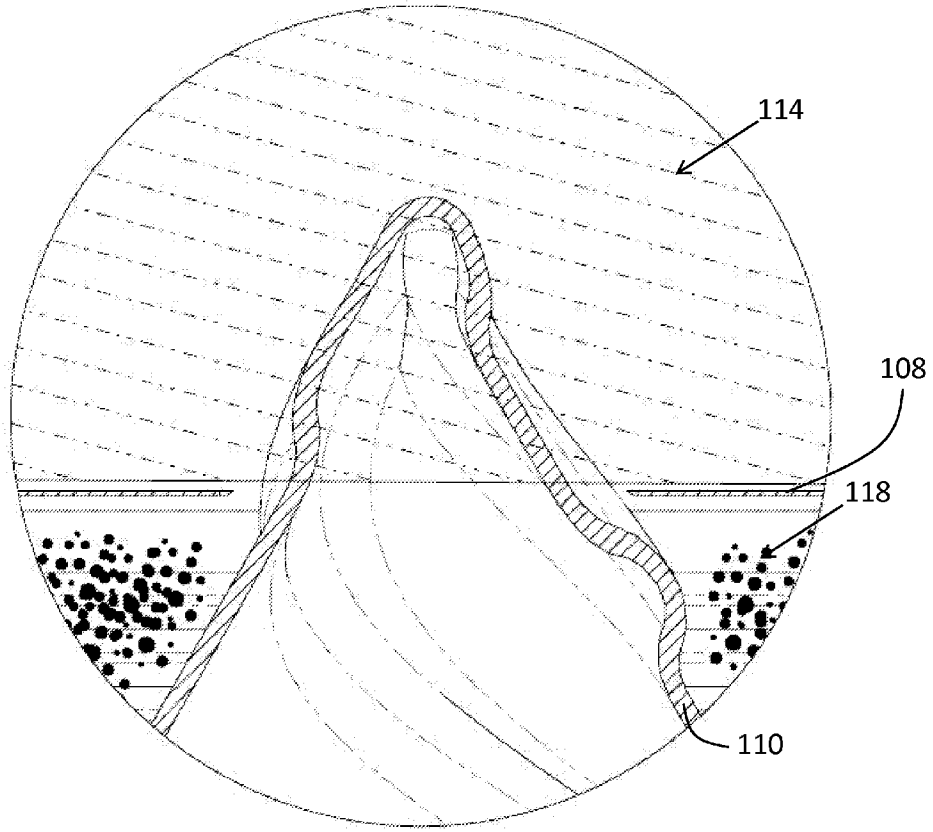
FIG. 4 is a close-up view of the puncturing member and partition of FIG. 3.
Figure 5:
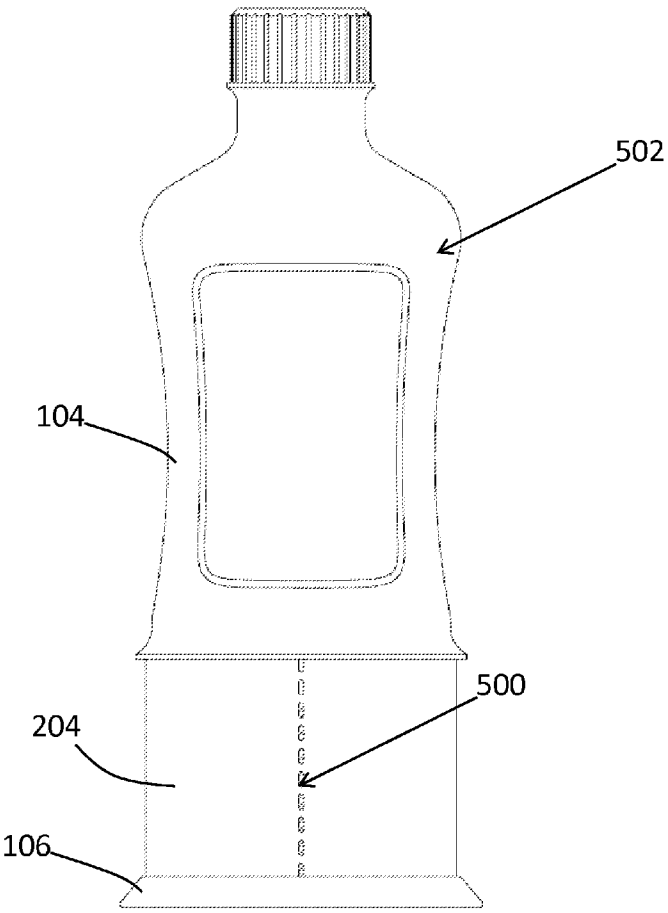
FIGS. 5-6 are elevational side views of the container of FIG. 1 with a removable jacket coupled thereto.

The container 100 operates to produce an effective and efficient method of mixing substances by employing collapsible side walls 106. Said differently, the side walls 122 of the second segment 104 and the puncturing member 110 have a first position along a second segment translation path (exemplified with the arrow 124) with the puncturing member disposed in a non-piercing configuration with respect to the partition 108, as shown in FIG. 1. The second segment 106 and the puncturing member 110 also have a second position along the second segment translation path 124 with the side walls 122 in a compressed state and with the puncturing member 110 disposed in a piercing configuration with respect to the partition 108, as shown in FIGS. 3-4. The piercing configuration results in fluidly coupling the first enclosed volume 112 and the second enclosed volume 116. In one embodiment, the second segment translation path 124 is linear and in other embodiments the path 124 is non-linear, or curvilinear.

In one embodiment, the side walls 122 are of a pleated configuration when in the first and second positions along the second segment translation path 124. Said another way, the side walls 122 are pre-fabricated with folds to facilitate the desired movement of the side walls 122 and/or second segment 106. The side walls 122 and second segment 106 may be of a flexible polymeric material such as silicone rubber. In other embodiments, the side walls 122 and second segment 106 may be of thin-walled aluminum or other material. In other embodiments, the side walls 122 are only pleated when placed in the second position. In further embodiments, the side walls 122 and second segment 106 are operable to translate via a telescopic connection with the first segment 104 or a threaded coupling connection with the first segment 104.

The movement of the second segment 106 and/or side walls 122 can also be described by the interplay between the container length (shown with arrow 128) separating the upper terminal edge 200 and lower terminal edge 202 of the container 100 when its various positions, as exemplified in FIGS. 1 and 3. Specifically, the container length 128 in the first position (FIG. 1) along the second segment translation path 124 is greater than the container length 128 when in the second position (FIG. 3). As described above, the difference in overall container length 128 is accomplished by applying a force to the lower terminal edge 202 of the second segment 106 surrounding the bottom surface of the body 102 of the container 100 to (1) compress the side walls 122 in a longitudinal direction of the container body 102, (2) translate the puncturing member in the longitudinal direction of the container body 102, and pierce the partition 108 with the puncturing member 110, thereby fluidly coupling the first and second enclosed volumes 112, 116.

In one embodiment, the walls 122 may advantageously be of a rigidity to support the weight of the first segment 104 and the weight of the first substance 114 housed therein without moving into the second position along the second segment translation path 124, i.e., piercing the partition 108. Said another way, the amount of force needed to translate or compress the side walls 122 and/or second segment 106 will be a force greater than the combined weight of the first segment 104 and contents 114. The first and second segments 104, 106 may be coupled together in one embodiment via adhesive or other fastener, and are of a polymeric, composite or other material. In other embodiments, the first and second segments 104, 106 may be integrally formed from one piece of material.

With reference now to FIGS. 2 and 5-7, another advantageous feature of the container 100 may include a removable jacket 204 coupled to the second segment 106 and at least partially surrounding an outer surface 206 of the side walls 122 of the second segment 106. Advantageously, the removable jacket 204 restricts movement of the side walls 122 of the second segment 106 and the puncturing member 110 along the second segment translation path 124 so that the puncturing member 110 does not pierce the partition 108. The jacket 204 may completely surround the side walls 122 and otherwise acts as an outer covering or casing to prevent inadvertent compression of the side walls 122 that may occur during transportation and storing of the container 100. To effectively and efficiently remove the jacket 204, the jacket 204 may include a plurality of perforations 500 that may span the jacket 204 in a longitudinal direction of the container body 102. Additionally, the jacket 204 may include a tab to facilitate initiating the removal of the jacket 204.

Figure 2:
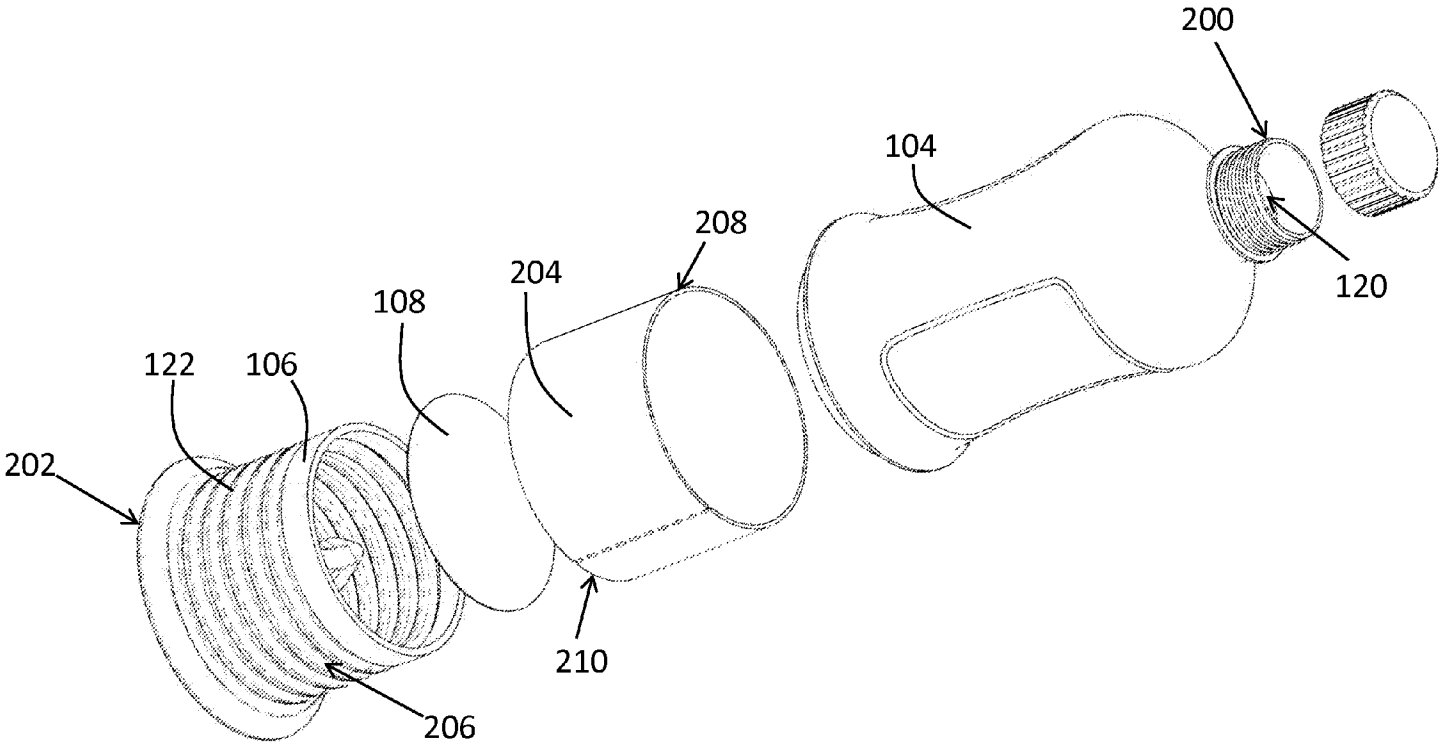
FIG. 2 is an exploded view of the container of FIG. 1.
Figure 8:
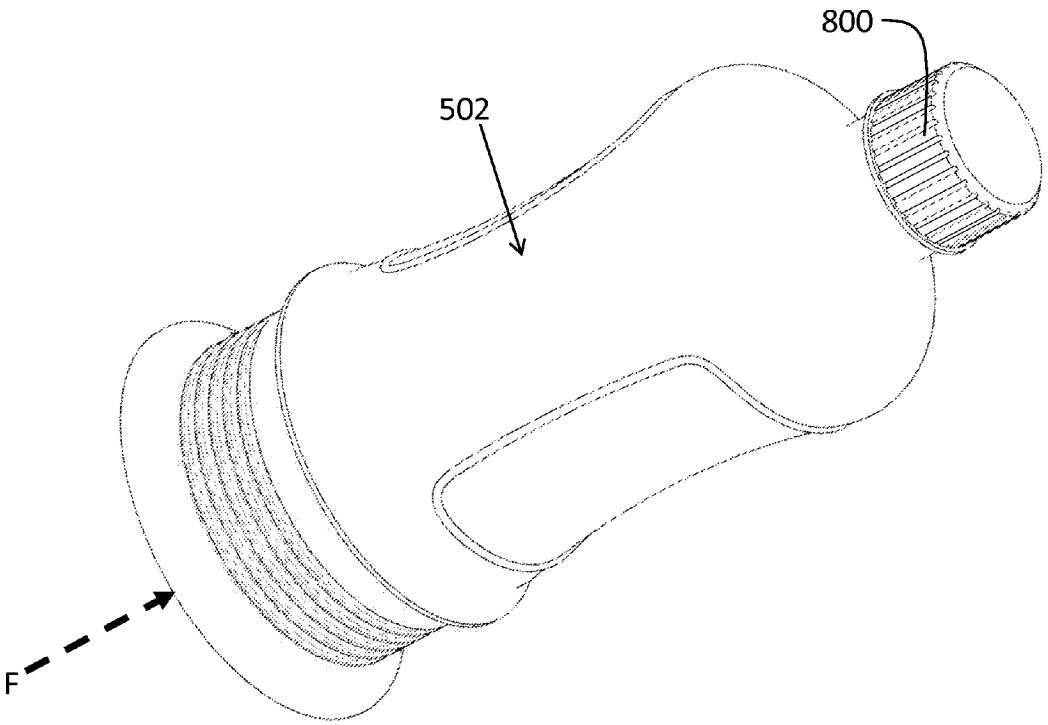
FIG. 8 is perspective view of the container of FIG. 1 with the jacket removed and with the second segment of the container in a compressed state.

With brief reference to FIGS. 1-2, the jacket 204 may include an upper end 208 and a lower end 210 opposing the upper end 208 of the jacket 204. To ensure the restriction of movement of the second segment 106, the upper and lower ends 208, 210 of the jacket 204 are respectively flanked by an upper shelf 130 defined by the first segment 104 and a lower shelf 132 defined by the second segment 106 when in the first position along the second segment translation path 124 (as shown in FIG. 1). Like the first and second segments 104, 106, the jacket 204 may also be of a cylindrical shape. As such, when the user desires to combine the two substances 114, 118 housed in the container 100, the user simply removes the jacket 204 and applies a force F to the lower end/bottom surface of the container 100 to compress or collapse the second segment 106 and/or side walls 122 (as shown in FIG. 8). The container 100 may also include a cap 800 for fluidly sealing the contents of the first enclosed volume 112 with the outside ambient environment.

Figure 6:
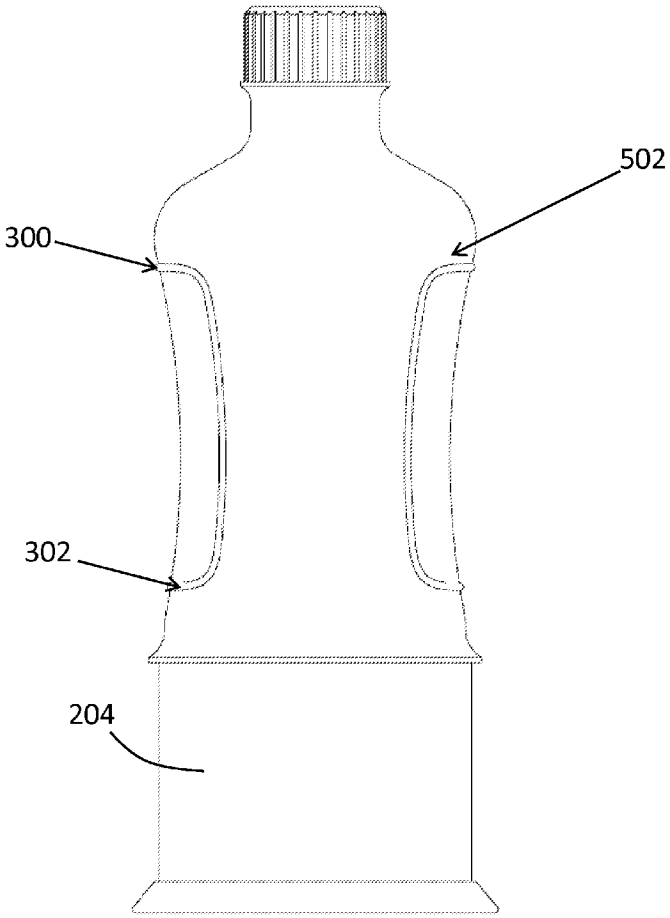
Figure 7:
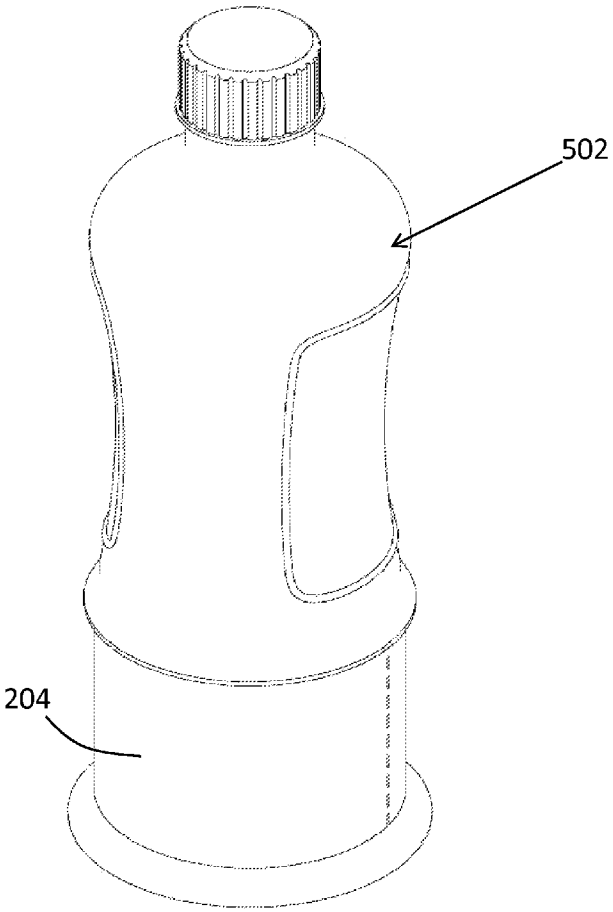
FIG. 7 is a downward-looking perspective view of the container of FIG. 1 with a removable jacket coupled thereto.

With reference now to FIGS. 3 and 5-8, the first segment 104 may include an outer surface 502 of a concave shape spanning in a longitudinal direction of the container body 102, as easily depicted in FIG. 6. The first segment 104 may also include a plurality of notches 300, 302 disposed on the outer surface 502 of the first segment 104, which are separated by the concave outer surface of the first segment 104. The concave surfaces are disposed between the notches 300, 302 so as to define a hand placement zone where the user can grasp and shake the container 100 to ensure adequate mixing of the substances 114, 118.

A collapsible portable container for mixing two substances has been disclosed that enables two or more substances to be effectively and efficiently housed and combined in independent chambers up until desired use by the user. The present invention effectuates this combination by permitting, in one embodiment, the entire lower portion of the container to translate so as to move a puncturing member in a piercing configuration with a partition separating the two above-disclosed segments.

What is claimed is:

1. A collapsible portable container for mixing two substances comprising:

a portable container body including:

a first segment having an outer surface and defining a first enclosed volume for housing a first substance, the first segment having a spout defining an upper terminal edge and an upper shelf disposed at a lower end of the first segment and extending inwardly from the outer surface of the first segment in a direction toward the first enclosed volume; and a second segment with an outer surface, with side walls operably configured to collapse, defining a second enclosed volume for housing a second substance, and with a lower shelf disposed at an upper end of the second segment and extending inwardly from the outer surface of the segment in direction toward the second enclosed volume, the side walls spanning from the upper shelf of the first segment to the lower shelf of the second segment and the second segment with a lower terminal edge opposite the upper terminal edge;

a puncturing member disposed within the second enclosed volume and spanning in a longitudinal direction of the container body; and a partition disposed in an interposing relationship between the first segment and the second segment, the partition operably configured to fluidically seal the first enclosed volume from the second enclosed volume, the side walls of the second segment and the puncturing member having a first position along a second segment translation path with the puncturing member disposed in a non-piercing configuration with respect to the partition and a second position along the second segment translation path with the side walls in a compressed state and with the puncturing member disposed in a piercing configuration with respect to the partition, fluidly coupling the first enclosed volume and the second enclosed volume.

2. The collapsible portable container according to claim 1, wherein:

the side walls are of a pleated configuration when in the first and second positions along the second segment translation path.

3. The collapsible portable container according to claim 2, wherein:

the side walls are of a flexible polymeric material.

4. The collapsible portable container according to claim 1, further comprising:

a removable jacket coupled to the second segment and at least partially surrounding an outer surface of the side walls of the second segment, the removable jacket restricting movement of the side walls of the second segment and the puncturing member along the second segment translation path.

5. The collapsible portable container according to claim 4, wherein the jacket further comprises:

a plurality of perforations spanning the jacket in a longitudinal direction of the container body.

6. The collapsible portable container according to claim 4, wherein the jacket further comprises:

an upper end and a lower end opposing the upper end of the jacket, wherein the upper end and lower end of the jacket are respectively flanked by an upper shelf defined by the first segment and a lower shelf defined by the second segment when in the first position along the second segment translation path.

7. The collapsible portable container according to claim 1, wherein the container further comprises:

a container length defined by the upper terminal edge and the lower terminal edge, wherein the container length in the first position along the second segment translation path is greater than the container length when in the second position along the second segment translation path.

8. The collapsible portable container according to claim 1, wherein the puncturing member of a conical shape.

9. The collapsible portable container according to claim 1, wherein the first and second segments are of a cylindrical shape.

10. The collapsible portable container according to claim 1, wherein the first segment is of a cylindrical shape and including a concave outer surface spanning in a longitudinal direction of the container body.

11. The collapsible portable container according to claim 10, wherein the first segment comprises:

a plurality of notches disposed on an outer surface of the first segment and separated by the concave outer surface of the first segment defining a hand placement zone.

12. The collapsible portable container according to claim 1, wherein the second segment translation path is linear and in a longitudinal direction of the container body.

13. A collapsible portable container for mixing two substances comprising:

a portable container body having a first segment having an outer surface, defining a first enclosed volume and an upper aperture fluidly coupled to the first enclosed volume, and an upper shelf disposed at a lower end of the first segment and extending inwardly from the outer surface of the first segment in a direction toward the first enclosed volume and a second segment having an outer surface, a lower shelf disposed at an upper end of the second segment and extending inwardly from the outer surface of the segment in direction toward a second enclosed volume defined by the second segment, and having side walls of a pleated configuration operably configured to collapse, the side walls spanning from the upper shelf of the first segment to the lower shelf of the second segment;

a puncturing member disposed within the second enclosed volume; and a partition disposed in an interposing relationship between the first segment and the second segment, the partition operably configured to fluidically seal the first enclosed volume from the second enclosed volume, the pleated side walls of the second segment and the puncturing member having a first position along a second segment translation path with the puncturing member disposed in a non-piercing configuration with respect to the partition and a second position along the second segment translation path with the pleated side walls in a compressed state and with the puncturing member disposed in a piercing configuration with respect to the partition, fluidly coupling the first enclosed volume and the second enclosed volume.

14. The collapsible portable container according to claim 13, wherein:

the pleated side walls are of a flexible polymeric material.

15. The collapsible portable container according to claim 13, further comprising:

a removable jacket coupled to the second segment and at least partially surrounding an outer surface of the pleated side walls of the second segment, the removable jacket restricting movement of the side walls of the second segment and the puncturing member along the second segment translation path.

16. The collapsible portable container according to claim 15, wherein the jacket further comprises:

a plurality of perforations spanning the jacket in a longitudinal direction of the container.

17. The collapsible portable container according to claim 15, wherein the container further comprises:

a container length defined by an upper terminal edge defined by the first segment and a lower terminal edge, opposing the upper terminal edge, defined by the second segment, wherein the container length in the first position along the second segment translation path is greater than the container length when in the second position along the second segment translation path.

18. A method of mixing two substances in a collapsible container comprising:

providing a portable container body having:

a first segment having an outer surface, defining a first enclosed volume and an upper aperture fluidly coupled to the first enclosed volume, and an upper shelf disposed at a lower end of the first segment and extending inwardly from the outer surface of the first segment in a direction toward the first enclosed volume; and a second segment having an outer surface, a lower shelf disposed at an upper end of the second segment and extending inwardly from the outer surface of the segment in direction toward a second enclosed volume defined by the second segment, and having side walls operably configured to collapse, a puncturing member disposed within the second enclosed volume, and a partition disposed in an interposing relationship between the first segment and the second segment, the second segment including a lower terminal edge surrounding a bottom surface of the container body and the side walls spanning from the upper shelf of the first segment to the lower shelf of the second segment; and applying a force to the lower terminal edge of the second segment surrounding the bottom surface of the container body to compress the side walls in a longitudinal direction of the container body, translate the puncturing member in the longitudinal direction of the container body, and pierce the partition with the puncturing member, thereby fluidly coupling the first and second enclosed volumes.

19. The method according to claim 18, wherein:

the side walls of the second segment are of a pleated configuration.

20. The method according to claim 18, further comprising:

applying a force to the lower terminal edge of the second segment surrounding the bottom surface of the container to compress the side walls a second segment and reduce an entire length of the second segment, the entire length of the second segment defined by the lower terminal edge of the second segment and an upper end of the second segment opposing the lower terminal edge of the second segment.

* * * * *